US006884973B2

(12) United States Patent
Castracane

(10) Patent No.: US 6,884,973 B2
(45) Date of Patent: Apr. 26, 2005

(54) HEATING PAD CONTROLLER WITH MULTIPLE POSITION SWITCH AND DIODES

(75) Inventor: Mark A. Castracane, Hattiesburg, MS (US)

(73) Assignee: Sunbeam Products, Inc., Boca Raton, FL (US)

( * ) Notice: Subject to any disclaimer, the term of this patent is extended or adjusted under 35 U.S.C. 154(b) by 125 days.

(21) Appl. No.: 10/215,969

(22) Filed: Aug. 9, 2002

(65) Prior Publication Data

US 2004/0026406 A1 Feb. 12, 2004

(51) Int. Cl.[7] ..... H05B 1/02

(52) U.S. Cl. ..... 219/491; 219/508; 219/506; 219/501; 219/212

(58) Field of Search ..... 219/505, 506, 219/501, 508, 497, 494, 212, 481, 528, 217; 607/96–98, 108

(56) References Cited

U.S. PATENT DOCUMENTS 4,897,526 A 1/1990 Anthony
5,451,747 A * 9/1995 Sullivan et al. ..... 219/528
5,708,256 A 1/1998 Montagnino et al.
5,861,610 A * 1/1999 Weiss ..... 219/497
6,107,744 A 8/2000 Bavaro et al.
6,582,456 B1 * 6/2003 Hand et al. ..... 219/212

* cited by examiner

*Primary Examiner*—Mark Paschall
(74) *Attorney, Agent, or Firm*—Lawrence J. Shurupoff

(57) ABSTRACT

A control circuit for a heating pad. The control circuit includes a two-pole, four-position slide switch. The four positions of the two-pole, four-position slide switch include off and three different heat settings of the heating pad. The control circuit also includes three heat setting indicators that are alternatively illuminated when the switch is in the three different heat settings. Diodes are used to direct electrical currents through the indicators as appropriate. The diodes and the two-pole, four-position slide switch are arranged so that current may be appropriately flow through, or may be blocked from flowing through, the indicators when the two-pole, four-position slide switch is in each of the three heating settings.

13 Claims, 3 Drawing Sheets

HEATING PAD CONTROLLER WITH MULTIPLE POSITION SWITCH AND DIODES

FIELD OF THE INVENTION

The present invention relates generally to heating pads, and more particularly to a controller for an electric heating pad.

BACKGROUND OF THE INVENTION

In general, an electric heating pad is a pad or other structure having an insulated electric heating element. The heating element may, for example, be heated by resistance via electricity, and may be provided as one or more metallic wires threaded in a serpentine pattern throughout the pad or arranged as a collection of parallel wires. The shape and size of the metallic wires may vary, and in some cases the wires may actually be small metallic threads.

An electric heating pad is typically plugged into a power outlet so that power may be supplied to the heating element, causing the production of heat. In this manner, the heating pad may be used to warm a desired area of the body, for example.

Contemporary heating pads usually include a user control, such as a dial, that permits a user to set the amount of heat output of the heating pad. This feature allows the consumer to set the heating pad to a setting that offers the desired amount of heat for a particular application and in accordance with the comfort level of the individual.

Although present heating pads work well for their intended purpose, a user may forget the setting at which the heating pad is set, and often would like to determine that setting by a quick visual inspection. However, except for the more expensive electronic heating pad controllers, determining the setting may be difficult, especially in the dark.

SUMMARY OF THE INVENTION

The present invention provides a controller, or control circuit, for a heating pad. The control circuit includes a two-pole, four-position slide switch. The four positions of the two-pole, four-position slide switch include off and three different heat settings of the heating pad. The control circuit also includes three heat setting indicators that are alternatively illuminated when the switch is in the three different heat settings. The heat setting indicators may be, for example, three different colors of LED lights. The heat setting indicators permit a user to see at a glance the present heat setting of the controller, even in the dark.

The control circuit of the present invention provides an inexpensive way to indicate a heat setting of a heat pad. Usually, these type of indicators are provided only in more expensive, electronic heating pad controllers.

In accordance with one aspect of the present invention, diodes are used to direct electrical currents through the indicators as appropriate. The diodes and the two-pole, four-position slide switch are arranged so that current may be appropriately allowed to flow through, or may be blocked from flowing through, the indicators when the two-pole, four-position slide switch is in each of the three heating settings.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details. Furthermore, well-known features may be omitted or simplified in order to not obscure the present invention.

Figure 1:
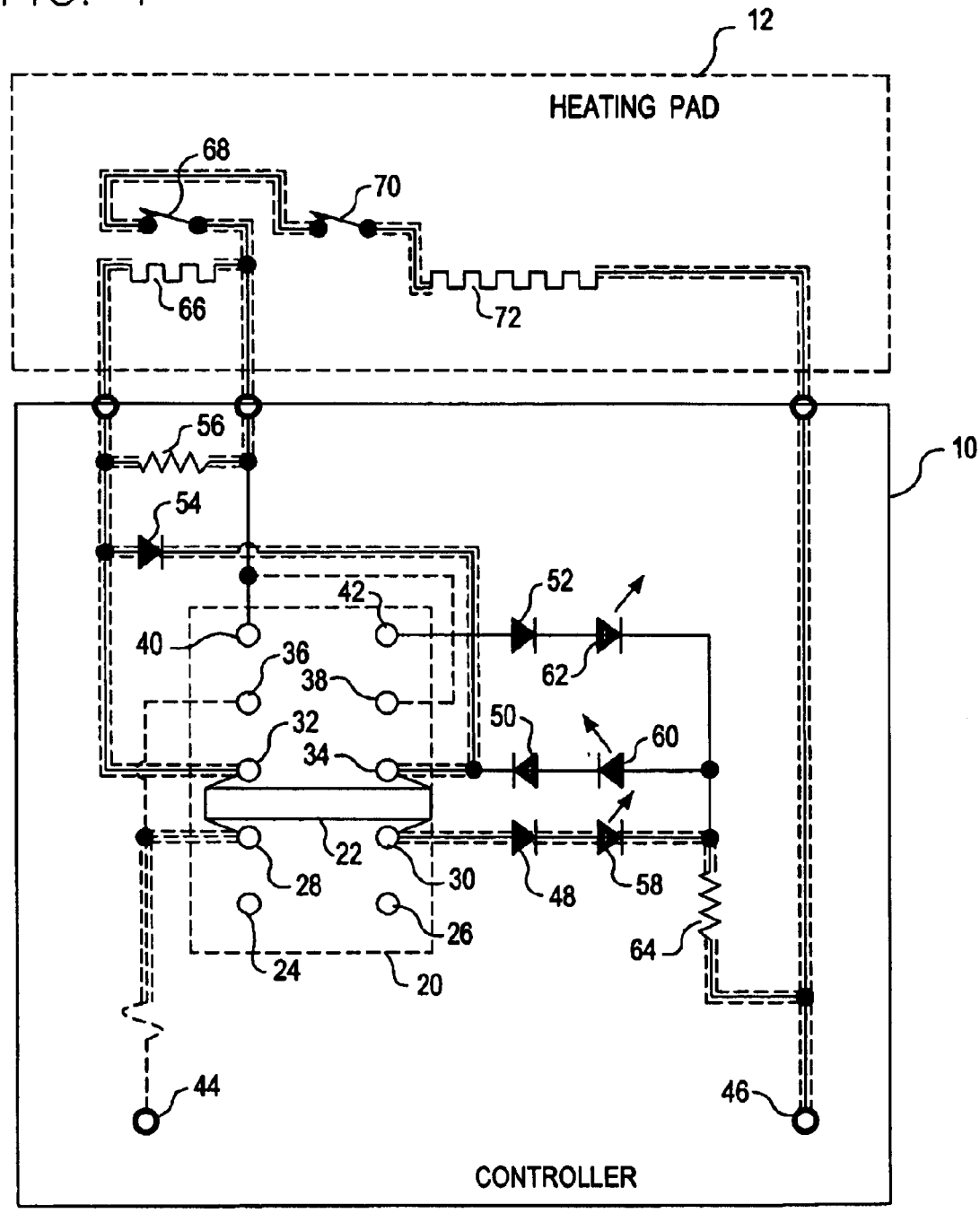
FIG. 1 is a schematic diagram showing a controller circuit for a heating pad in accordance with one aspect of the present invention, with a slider for a switch of the control circuit in a "low" position.

Referring now to the drawings, in which like reference numerals represent like parts throughout the several views, FIG. 1 shows a control circuit 10 for a heating pad 12 in accordance with one embodiment of the present invention. In summary, the control circuit 10 includes a switch 20 that allows for low, medium, and high settings in which three different heat outputs are supplied by the heating pad 12. In addition to the three heat settings, the control circuit 10 includes indicators (e.g., LED indicators 58, 60, 62) that are illuminated in accordance with the setting of the control circuit 10.

Although referred to as a control circuit 10 herein, the control circuit may alternatively be described as a controller or control for the heating pad 12. In general, a controller or control is a device or mechanism used to regulate or guide the operation of a machine, apparatus, or system. For the present invention, the control circuit, controller, or control regulates the heat output of the heating pad 12 and illumination of the indicators 58, 60, 62.

The switch 20 is preferably a two-pole, four-position slide switch. The switch 20 shown in the drawings includes a slider 22 that can be moved between terminals 24, 26, 28, 30, 32, 34, 36, 38, 40, and 42. The slider 22 is a mechanical, nonconductive bar, and current does not flow along its length. However, when the slider 22 is positioned between adjacent sets of terminals, electrical contact is made between the adjacent electrical terminals. For example, when the slider 22 is in a "low" setting shown in FIG. 1, the slider is located between the terminals 28 and 30 and the terminals 32 and 34. The slider provides an electrical connection between the terminals 28 and 32, and between the terminals 30 and 34. Likewise, when the slider 22 is in the "medium" position shown in FIG. 2, electrical contact is made between the terminals 36 and 32 and the terminals 38 and 34. Similarly, when the slider 22 is in the "high" position shown in FIG. 3, electrical contact is made between the terminals 40 and 36 and the terminals 42 and 38.

For the switch 20 shown in the drawings, the position of the slider 22 in FIG. 1 corresponds to a "low" heat setting for the heating pad 12. The position of the slider 22 in FIG. 2 corresponds to a "medium" position or heat setting, and the position in FIG. 3 corresponds to a "high" heat setting or position. A designer of ordinary skill in the art may rearrange the control circuit 10 as necessary so that the different settings may correspond to appropriate or desired heat settings for the heating pad 12.

The control circuit 10 includes live and ground terminals 44, 46 attached to an appropriate AC power source (not shown). Fuses and/or surge protectors (e.g., a varistor) may be used for protection of the components of the control circuit 10.

A series of diodes 48, 50, 52, 54 are used in the control circuit 10 to selectively block current or allow the passage of current, based upon the position of the slider 22. The function and locations of the diodes 48, 50, 52, 54 are described further below.

A first current-limiting resistor 56 is wired between the terminals 32 and 40. Light emitting diodes (LED's) 58, 60, 62 are also located in the circuitry, the location and function of which are also described below. A second resistor 64 is located between the ground terminal 46 and the LED's 58, 60, 62 for current limiting.

The heating pad 12 includes a tickler heater 66 adjacent to a first thermostat 68. The tickler heater 66 may be, for example, a resistive element that generates heat as current flows through it. A second thermostat 70 is wired to the tickler heater 66 and the first thermostat 68, and is located remote of the tickler heater 66. A main heater 72 is also wired in series with the first and second thermostats 68, 70. The main heater 72 may also be a resistive element.

The LED 58 is wired in series with the diode 48, and is connected to the resistor 64 and the terminal 30. The LED 58 and the diode 48 are arranged so that current may flow only in the direction from the terminal 30 to the resistor 64, and not in the opposite direction. The LED 60 and the diode 50 are wired in series between the resistor 64 and the terminal 34, and are arranged so that current may flow only in the direction from the resistor 64 to the terminal 34. The LED 62 and the diode 52 are wired in series between the resistor 64 and the terminal 42, and are arranged so that current may flow only in the direction from the terminal 42 to the resistor 64, and not in the opposite direction.

The diode 54 is connected on a wire extending between the terminals 32 and 34. The terminals 28 and 36 are connected to the live terminal 44. The resistor 56 and the tickler heater 66 are connected in parallel between the terminal 40 and the terminal 32. The thermostat 68 is additionally attached to the terminal 40.

Figure 2:
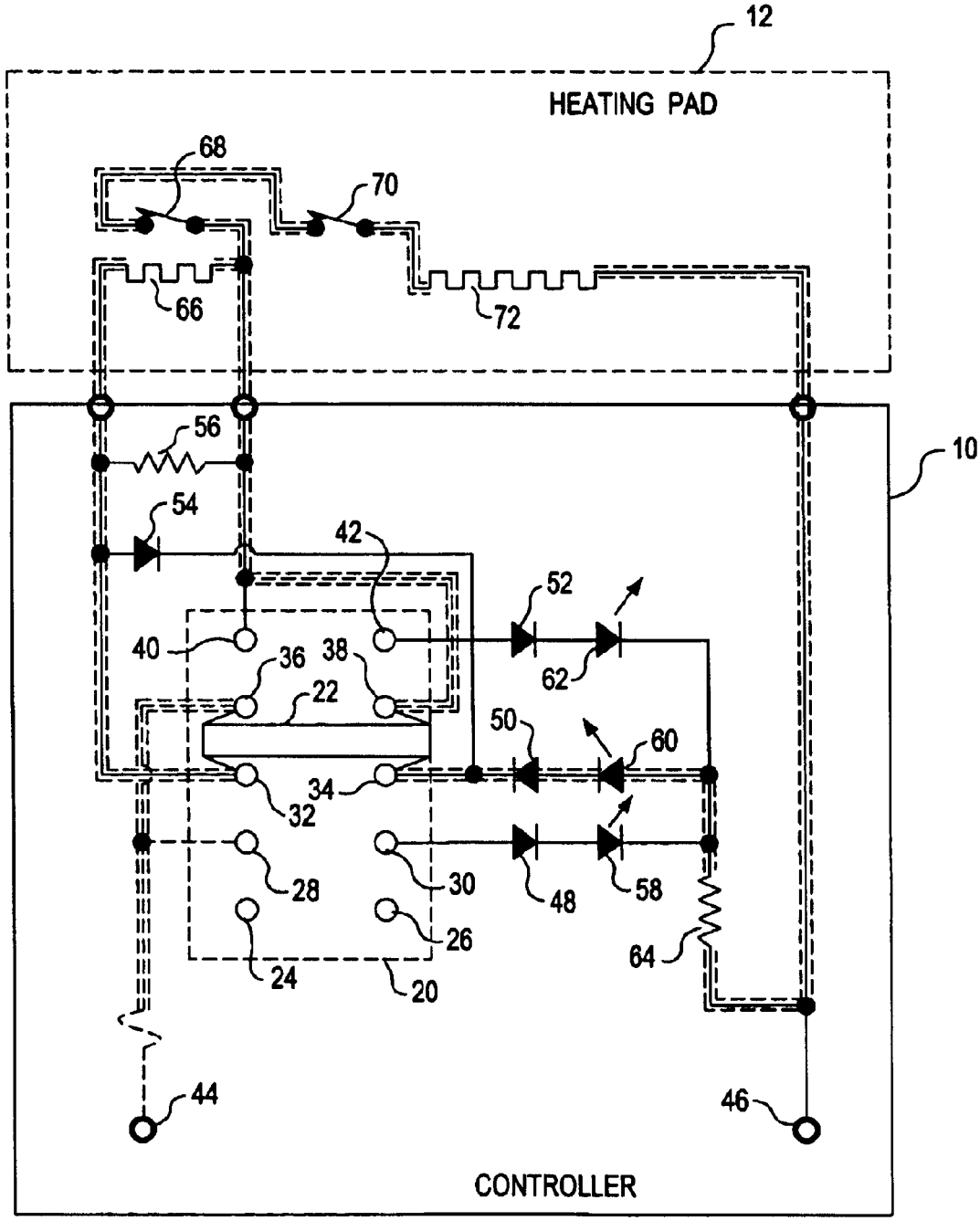
FIG. 2 is a schematic diagram of the control circuit of FIG. 1, with the slider in a "medium" position.
Figure 3:
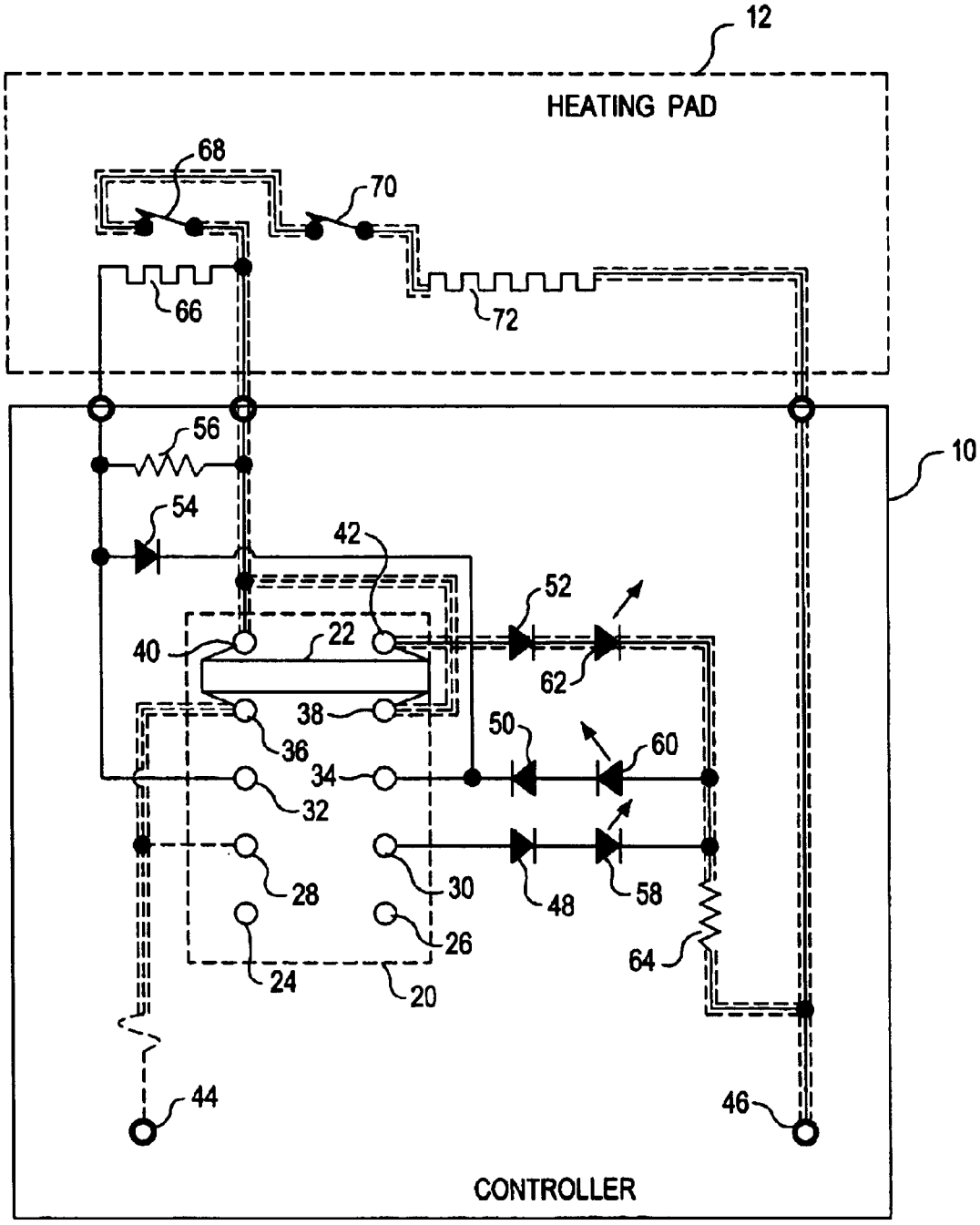
FIG. 3 is a schematic diagram of the control circuit of FIG. 1, with the slider in a "high" position.

The operation of the control circuit 10 can be understood with reference to FIGS. 1–3. When the slider 22 is in the off position, current is prevented from flowing into the control circuit 10. The slider 22 in this position is between the terminals 24, 26 and the terminals 28, 30.

When the slider 22 is moved to the low position, such as is shown in FIG. 1, electrical contact is made between the terminals 28 and 32 and the terminals 30 and 34. In this position, the LED 58 is illuminated via a current path through the diodes 54 and 48 and the resistor 64 during the positive half-cycle of the AC wave. The LED 60 remains off because the combination of the diodes 50 and 54 prevents current flow through the LED 60 in both the negative and positive half cycles.

Also, in the low heat setting of FIG. 1, the tickler heater 66, connected in series with the main heater 72, dissipates maximum power. Current also flows through the main heater 72 causing it to warm. In this low setting, current flows through the tickler heater 66 in both the negative and positive half cycles, providing maximum power. As the tickler heater 72 generates heat, the thermostat 68 prematurely turns off, thus maintaining the main heater 72 at a lower overall temperature.

In the medium setting shown in FIG. 2, the tickler heater 66 is shunted by the diode 54, so that it dissipates only half the power that it does in the low setting. That is, a portion of the current bypasses the tickler heater 66 by flowing through the diode 54, to the terminal 34, through the slider 22 to the terminal 38, and from the terminal 38 directly to terminal 40, and from that terminal onto the thermostat 68. This directing of some of the current around the tickler heater 66 causes the tickler heater to produce less heat, and causes the adjacent thermostat 68 to open later in time, resulting in a higher heating pad temperature produced by the main heater 72.

When in the medium setting, the negative half-cycle of the AC wave flows through the LED 60, the diode 50, and the resister 56, allowing illumination of the LED 60. The current flow through the LED also flows through the resistor 56 and/or the tickler heater 66.

When the slider 22 is in the high setting as shown in FIG. 3, the tickler heater 66 is bypassed completely. The current through the main heater 72 is therefore controlled by both thermostats 68, 70, and the heating pad 12 may reach high temperatures before the thermostat opens. The positive half-cycle of the AC wave flows through the diode 52 and the LED 62, illuminating the LED 62.

The diodes 48, 50, 52, 54 are arranged in the circuit so that the LED's 58, 60, 62 may receive current when the slider 22 is in the appropriate setting. The LED's light independently, without the use of active electronics or mechanical shutters or other devices.

Variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A heating pad, comprising:

a heating element;

controls for determining the amount of power supplied to the heating element, the controls comprising:

power nodes for connecting to an AC power source;

a multiple position switch having at least two settings other than off, each of the settings comprising a separate set of contacts, the multiple position switch being connected to the power nodes and the heating element, the different settings on the multiple position switch representing different heat output settings for the heating element;

a plurality of indicators, at least one each corresponding to each of the at least two settings of the multiple position switch; and a plurality of diodes connected between the power nodes and the multiple position switch, the diodes being arranged so that different indicators are supplied power when the multiple position switch is in the at least two settings;

for each setting of the multiple position switch, the set of contacts and the plurality of diodes being arranged and configured when the multiple position switch is at the setting to both supply power from the power nodes to the heating element and supply power from power nodes to the corresponding indicator for the setting so that the indicator provides a signal.

2. The heating pad of claim 1, wherein the indicators comprise light emitting diodes, and the signal comprises lighting of the light emitting diode.

3. The heating pad of claim 2, wherein the indicators comprise a separate light emitting diode for each setting of the multiple position switch.

4. The heating pad of claim 1, wherein the multiple position switch comprises a two-pole, four-position slide switch.

5. The heating pad of claim 4, wherein the indicators comprise light emitting diodes.

6. The heating pad of claim 5, wherein the indicators comprise a separate light emitting diode for each setting of the multiple position switch.

7. The heating pad of claim 4, wherein the two-pole, four-position slide switch comprises a first setting in which the heating element is off, a second setting in which the heating element supplies a low heat output, a third setting in which the heating element supplies a medium heat output, and a fourth setting in which the heating element supplies a high heat output.

8. The heating pad of claim 1, wherein the multiple position switch is a mechanical switch.

9. A heating pad, comprising:

a heating element;

controls for determining the amount of power supplied to the heating element the controls comprising:

power nodes for connecting to an AC power source;

a two-pole, four-position slide switch, the two-pole, four-position slide switch comprising a first setting in which the heating element is off, a second setting in which the heating element supplies a low heat output, a third setting in which the heating element supplies a medium heat output, and a fourth setting in which the heating element supplies a high heat output, the two-pole, four-position slide switch being connected to the power nodes and the heating element so that different settings on the two-pole, four-position slide switch represent different heat output settings for the heating element;

a plurality of indicators, at least one each corresponding to each of the settings of the two-pole, four-position slide switch; a plurality of diodes connected between the power nodes and the two-pole, four-position slide switch, the diodes being arranged so that different indicators are supplied power when the two-pole, four-position slide switch is in the settings; and a tickler healer, and wherein in the second setting, the controls supply full power to the tickler heater, in the third setting the controls supply half power to the tickler heater, and in the fourth setting the controls bypass the tickler healer.

10. The heating pad of claim 9, wherein in the first setting, a first diode and a second diode of the plurality of diodes permits power to flow through a first indicator of the plurality of indicators in the second position, and the first diode and a third diode block power flow through a second indicator, and wherein in the second setting, the third diode permits flow of power through the second indicator.

11. The heating pad of claim 1, wherein the multiple position switch comprises a first setting in which the heating element is off, a second setting in which the heating element supplies a low heat output, a third setting in which the heating element supplies a medium heat output, and a fourth setting in which the, heating element supplies a high heat output.

12. A heating pad, comprising:

a heating element;

controls for determining the amount of power supplied to the heating element, the controls comprising:

power nodes for connecting to an AC Dower source;

a multiple position switch, the multiple position switch comprising a first setting in which the heating element is off, a second setting in which the heating element supplies a low heat output, a third setting in which the heating element supplies a medium heat output, and a fourth setting in which the heating element supplies a high heat output, the multiple position switch being connected to the power nodes and the heating element so that different settings on the multiple position switch represent different heat output settings for the heating element;

a plurality of indicators, at least one each corresponding to the at least two settings of the multiple position switch; and a plurality of diodes connected between the power nodes and the multiple position switch, the diodes being arranged so that different indicators are supplied power when the multiple switch is in the at least two settings;

a tickler heater, and wherein in the second setting, the controls supply full power to the tickler heater, in the third setting the controls supply half power to the tickler heater, and in the fourth setting the controls bypass the tickler heater.

13. The heating pad of claim 12, wherein in the first setting, a first diode and a second diode of the plurality of diodes permits power to flow through a first indicator of the plurality of indicators in the second position, and the first diode end a third diode block power flow through a second indicator, and wherein in the second setting, the third diode permits flow of power through the second indicator.

* * * * *